US009587882B2

(12) United States Patent
Piret et al.

(10) Patent No.: US 9,587,882 B2
(45) Date of Patent: Mar. 7, 2017

(54) HEARTH FOR A METALLURGICAL FURNACE HAVING AN IMPROVED WALL LINING

(75) Inventors: Jacques Piret, Liege (BE); Gilles Kass, Soleuvre (LU)

(73) Assignee: PAUL WURTH S.A., Luxembourg (LU)

( * ) Notice: Subject to any disclaimer, the term of this patent is extended or adjusted under 35 U.S.C. 154(b) by 437 days.

(21) Appl. No.: 13/812,335

(22) PCT Filed: Jul. 26, 2011

(86) PCT No.: PCT/EP2011/062852
§ 371 (c)(1),
(2), (4) Date: Jan. 25, 2013

(87) PCT Pub. No.: WO2012/013689
PCT Pub. Date: Feb. 2, 2012

(65) Prior Publication Data

US 2013/0119589 A1 May 16, 2013

(30) Foreign Application Priority Data

Jul. 27, 2010 (LU) ..... 91713

(51) Int. Cl.
*F27B 1/14* (2006.01)
*C21B 7/06* (2006.01)
(Continued)

(52) U.S. Cl.
CPC ..... *F27B 1/14* (2013.01); *C21B 7/06* (2013.01); *C21C 5/44* (2013.01); *F27D 1/0006* (2013.01); *F27D 1/14* (2013.01)

(58) Field of Classification Search
CPC ..... C21B 7/06; C21C 5/44; F27D 1/14; F27D 1/0006; F27B 1/14; C04B 35/013; C09D 101/12
(Continued)

(56) References Cited

U.S. PATENT DOCUMENTS 3,262,687 A * 7/1966 Freygang ..... C21B 7/106 266/283
3,520,526 A * 7/1970 Savage ..... C21B 7/06 266/286
(Continued)

FOREIGN PATENT DOCUMENTS

CN 2141545 Y 9/1993
CN 101419020 A 4/2009
(Continued)

OTHER PUBLICATIONS

Japanese Office Action issued Oct. 14, 2014 re: Japanese Application No. P2013-521118; citing: JP 09-295875A, JP 56-170245A and U.S. Pat. No. 6,857,716 B2.
(Continued)

*Primary Examiner* — Scott Kastler
*Assistant Examiner* — Michael Aboagye
(74) *Attorney, Agent, or Firm* — Cantor Colburn LLP

(57) ABSTRACT

A hearth for a metallurgical reactor, in particular for a blast furnace, has an outer shell and an annular wall lining of refractory material inside the shell, the wall lining having a lower region with a multi-layered construction, a radially inner layer faces the interior of the hearth and includes at least one inner ring of refractory elements, radially outer layer faces the outer shell and has at least one outer ring of refractory elements, where in the at least one inner ring elements are made of a first carbonaceous refractory material that is different from one or more carbonaceous refrac-
(Continued)

tory materials of the elements in the outer layer such that, the first refractory material contains, in a proportion of at least 5% by mass in total, at least one property-enhancing additive other than metallic silicon or silicon carbide. In beneficial combination therewith, the at least one inner ring has a wall thickness of less than 45%, of the corresponding total wall thickness of the wall lining.

15 Claims, 4 Drawing Sheets

(51) Int. Cl.
*C21C 5/44* (2006.01)
*F27D 1/00* (2006.01)
*F27D 1/14* (2006.01)

(58) Field of Classification Search
USPC ..... 266/200, 193, 280, 282, 286, 283, 284, 266/197; 432/4, 248, 119, 103, 105, 247, 432/252; 373/72, 75, 76
See application file for complete search history.

(56) References Cited

U.S. PATENT DOCUMENTS

| | | | | |
|---|---|---|---|---|
| 3,953,007 | A * | 4/1976 | van Laar | 266/193 |
| 4,468,780 | A | 8/1984 | Schellberg et al. | |
| 6,875,716 | B2 * | 4/2005 | Ishii et al. | 501/100 |
| 2002/0183189 | A1 | 12/2002 | Ishii et al. | |
| 2007/0267789 | A1 * | 11/2007 | Mittag et al. | 266/285 |

FOREIGN PATENT DOCUMENTS

| | | | | |
|---|---|---|---|---|
| DE | 29515315 | U1 | 1/1996 | |
| EP | 1275626 | A1 | 1/2003 | |
| EP | 1975258 | A1 | 10/2008 | |
| GB | 2022229 | * | 12/1979 | F27D 1/16 |
| GB | 2022229 | A | 12/1979 | |
| JP | 56170245 | A | 12/1981 | |
| JP | 09295875 | A | 11/1997 | |

OTHER PUBLICATIONS

International Search Report for corresppnding application No. PCT/EP2011/062852 file Jul. 26, 2011; Mail date Oct. 14, 2011.
Written Opinion for corresppnding application No. PCT/EP2011/062852 file Jul. 26, 2011; Mail date Oct. 14, 2011.
Von F. Dobrowsky, "Neuzeitliches Zustellkonzept fur die Ofen der Kalkindustrie unter besonderer Berucksichtigung der Normalschachtofen", ZKG International, vol. 43, No. 8 Aug. 1, 1990, pp. 376-380, XP000175435.

* cited by examiner

HEARTH FOR A METALLURGICAL FURNACE HAVING AN IMPROVED WALL LINING

TECHNICAL FIELD

The present invention generally relates to the construction of the hearth of a metallurgical reactor, in particular of an iron-making furnace such as a blast furnace. More specifically, the invention relates to the configuration of the refractory that lines the wall of the hearth.

BACKGROUND ART

A hearth of a metallurgical furnace usually has an outer steel shell, typically with at least one taphole for tapping molten metal, and a lining of refractory material for containing the molten metal bath at high temperatures, in excess of 1100° C. The lining includes a lateral lining of the shell, hereinafter called wall lining, and a lining in the bottom of the hearth i.e. the hearth pad.

In the field of blast furnaces, there are various approaches for constructing a wall lining. In a well-known approach, the wall lining is a brickwork of multiple concentric rings of comparatively small bricks. These are typically made of high-conductivity hot-pressed carbon. Another approach uses comparatively larger blocks of refractory, typically also of carbonaceous material (including carbon, hot-pressed carbon, graphite, semi-graphite and hot-pressed semi-graphite). Usually, large blocks are installed in a single thickness reaching from the shell to the hot face so that the lining consists of the same material over its entire cross-section. A further known approach, which aims at increasing protection and durability of the wall lining, consists in providing an additional so-called ceramic cup including a lateral inner layer of high-melting point ceramics, e.g. high alumina content pre-cast blocs, for protecting the carbonaceous blocs of the wall lining. Also well-known are hearth configurations with a composite lining of two annular layers of different materials. Usually, materials are used so that thermal conductivity of the outer layer is higher than that of the inner layer with the hot face in contact with molten iron.

A composite lining configuration, especially for the bosh and for the shaft zone of a blast furnace is disclosed for example in U.S. Pat. No. 3,953,007. This patent suggests two separate layers of different carbonaceous refractory material e.g. an outer layer of high-thermal conductivity graphite blocs and an inner layer of silicon-carbide having high resistance to wear and chemical attack. In fact, in the field of blast furnace refractories it is known to add silicon carbide or silicon metal to the carbonaceous mix in order to improve (reduce) permeability, reduce pore sizes and improve abrasion resistance.

Concerning the hearth wall lining more specifically, a similar layered approach is proposed in U.S. Pat. No. 3,520,526. This patent suggests providing two layers of substantially equal thickness, with the thickness of the outer layer being preferably from 0.8 to 1.2 times that of the inner layer. More specifically, U.S. Pat. No. 3,520,526 suggests that the radially outer layer, which is in contact with the cooling system, e.g. with the staves, should have a thermal conductivity that is substantially higher than that of the radially inner layer, in particular at least five times higher.

Durability of the refractory lining of the furnace hearth is a critical factor as regards campaign duration, since failure of the refractory lining is one of the most common reasons for premature shut-downs. Accordingly, in order to achieve the desired campaign duration, sophisticated refractory materials and configurations are state-of-the-art and related expenses are accepted. Required qualities are among others: good resistance to erosion by molten pig iron, good resistance to oxidation, low carburization dissolution rate, high mechanical strength and high thermal conductivity to maintain the hot face at a temperature as low as possible. Consequently, considering the total construction cost of a hearth, the refractory lining on its own may well make up more than two thirds (66%) of the total cost, i.e. exceed the cost of the steel shell and the hearth cooling system. Obviously, in case of a reline keeping the existing shell and cooling construction, the refractory constitutes an even more important proportion in total cost.

On the other hand, as is also well-known, there is an ongoing trend towards ever increasing production rates. The production capacity of a blast furnace is limited, among others but in notable manner, by the useful internal volume of the hearth, which volume is radially limited by the lining thickness and the shell diameter.

In view of the foregoing, there is obviously a desire for reducing the total wall thickness of the hearth wall lining so as to achieve either, or preferably both, of the benefits of reduced lining cost and increased useful internal volume of the hearth.

BRIEF SUMMARY

Accordingly, the invention provides a hearth configuration for a metallurgical furnace, in particular for a blast furnace, which permits a reduction of the wall thickness (i.e. thickness in radial direction) of the wall lining with minimum or no adverse impact on durability of the wall lining.

In known manner, the hearth of a metallurgical reactor, in particular of a blast furnace, comprises an outer metallic support structure (hereinafter: the shell), which, in case of a blast furnace, has at least one tap hole for tapping molten metal. For containing the bath including molten metal, the hearth has an annular fully circumferential wall lining of refractory material that is contained inside the shell and that is typically backed by a cooling system, e.g. outer rings of stave coolers between the shell and the lining. The present invention is specifically concerned with the configuration of the lower region of the wall lining, which is most typically exposed to the most severe conditions. In a blast furnace, the lower region is located below the tap hole. In accordance with the invention, this lower region includes a first radially inner layer that faces the interior of the hearth and comprises at least one and typically several vertically stacked rings of refractory elements, e.g. small bricks or comparatively large blocks. The lower region further comprises a second radially outer layer that faces the outer shell and backs the inner layer. The outer layer also comprises at least one and typically several vertically stacked rings of refractory elements. Further in accordance with the invention, at least one of the inner rings in the lower region comprises elements made of a first carbonaceous refractory material that is different from the one or more carbonaceous refractory materials of which the elements in the outer layer are made.

According to an important aspect of the invention, the carbonaceous refractory material of the at least one inner ring is a high-performance refractory that, to this effect, contains at least one property-enhancing additive, in a proportion of at least 5% by mass in total, that is not contained in the refractory material of the elements in the outer layer and that is provided in addition to or as an alternative to either or both of the well-known property-enhancing additives metallic silicon and silicon carbide, which are comparatively inexpensive.

According to another important aspect, the at least one inner ring has a thickness of less than 45%, preferably less than 35%, of the total wall thickness of the wall lining at the height of the inner ring in question.

As will be appreciated, the present invention proposes proceeding contrary to accepted practice and widely held belief, according to which the more economical i.e. less expensive refractory should be placed at the exposed hot face (see for instance the aforementioned U.S. Pat. No. 3,520,526). Moreover, in the course of developments leading to the present invention, it has been theorized that even a comparatively small thickness of high-performance refractory, e.g. a TiC boosted refractory, when located on the exposed surface, may lead to significantly increased lining performance and durability. Accordingly, the proposed configuration allows reducing the thickness of the backing outer layer and more generally the total wall lining thickness significantly when compared to the prior art. Moreover, the proposed configuration is expected to enable, at considerably lower cost, a lining performance equivalent to what has hitherto been achievable only with a full-extent thickness (hot face to cold face) of corresponding high-performance refractory material. Thus, constituting an inner layer with a refractory material having improved properties, e.g. increased resistance to wear by liquid hot metal, allows to reduce wall lining thickness with minimum or no adverse impact on durability of the wall lining.

According to an important aspect of the invention, the first refractory material contains 50-85% by mass of carbon and, as an additional property-enhancing additive, 5-20% by mass in total of one or more material(s) chosen from the group of metallic titanium, titanium carbide, titanium nitride and titantium carbonitride or titanium oxide. A most preferable refractory further contains 5-15% by mass in total of metallic silicon; and 5-15% by mass in total of alumina. An exemplary method for making such a refractory is known e.g. from EP 1 275 626. According to another aspect, the first refractory material preferably has a thermal conductivity of at least 15 W/mK at 600° C., as is achieved with this most preferred refractory for example.

According to an important aspect of the invention, the at least one inner ring comprises elements having an anchoring portion on their outer face and the at least one outer ring comprises elements having an anchoring portion on their inner face, each pair of anchoring portions cooperating for securing against radially inward and circumferentially tangential dislocation an element of the inner ring to a corresponding element of the outer ring. As will be appreciated, this configuration enables a further reduction of the thickness of the inner layer without compromising mechanical stability of its construction as opposed to a simple masonry-like construction. In this configuration, the cooperating anchoring portions preferably have conjugated, ideally smoothly rounded, shapes that provide a continuous gap in between the outer and inner faces of facing elements.

With the aforementioned anchoring, the at least one outer ring can beneficially comprise large-width blocks made of a second carbonaceous refractory material, the at least one outer ring comprising large-width blocks that have a width greater than 65% of the total wall thickness of the wall lining at the height of the outer ring. Accordingly, the at least one inner ring can comprises small-width blocks having a width of less than 35% of the total wall thickness of the wall lining at this height. In a preferred and simple type of anchoring, the at least one inner ring has small-width blocks with a mushroom-shaped anchoring protrusion on their outer face whereas the at least one outer ring has large-width blocks with a conjugated mushroom-shaped anchoring recess on their inner face. The protrusions and recesses are thus engaged and cooperated to secure the small-width blocks against radially inward and circumferentially tangential dislocation with respect to the large-width blocks so as to further increase constructional stability. In a configuration that reduces manufacturing cost by reducing the amount of special block with anchoring means, the at least one inner ring comprises small-width blocks of a first type and small-width blocks of a second type that are arranged in alternating fashion. The first type has an anchoring portion whereas the second type is devoid of anchoring portion. In order to secure the second type of small-width blocks, the first and second type of small-width blocks have respective conjugated horizontal cross-sections.

In a preferred embodiment, the lower region further comprises an intermediate ramming layer that extends vertically in between the outer and the inner layer. Preferably, this ramming layer is made of a composition that comprises: a fine granular phase comprising graphite and a coarse granular phase comprising microporous carbon.

In a most simple construction, the inner ring is made, in radial direction, of a single refractory block having a width equal to the thickness of the inner ring and, similarly, the outer ring is made, in radial direction, of a single refractory block having a width equal to the thickness of the outer ring. Typically, the inner layer comprises a vertical sequence of at least two, preferably three to four, vertically stacked inner rings of refractory elements, in particular refractory blocks, made of the first refractory material.

Concerning achievable reductions in total wall-thickness, in case the inner layer forms the hot face of the lining, the inner layer can have a thickness in the range of 200 mm to 600 mm, preferably in the range of 250 to 550 mm, and the wall lining has a total wall thickness of less than 1350 mm, preferably less than 1100 mm (at the level of the lowermost inner ring). In case a ceramic cup is provided to form the hot face, the inner layer has a thickness in the range of 250 mm to 400 mm and the wall lining, including the ceramic layer, has a total wall thickness of less than 1500 mm (at the level of the lowermost inner ring).

As will be understood, a hearth according the present invention is, although not exclusively, particularly suited for industrial application in a blast furnace, either as a retrofit by relining an existing furnace or as a design for a new construction.

BRIEF DESCRIPTION OF THE DRAWINGS

Further details and advantages of the present invention will be apparent from the following detailed description of several not limiting embodiments with reference to the attached drawings, wherein.

Throughout these drawings, features which have substantially identical function or structure are referred to by identical reference numerals.

DETAILED DESCRIPTION WITH RESPECT TO THE DRAWINGS

Figure 1A:
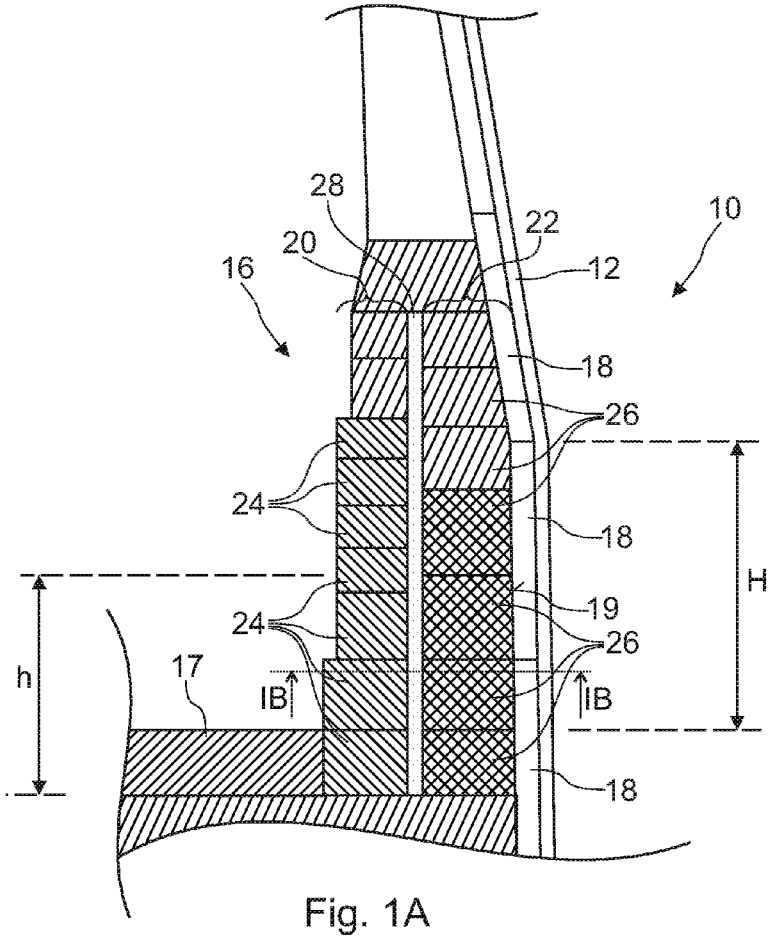
FIG. 1A-B illustrate a blast furnace hearth according to a first embodiment of the invention, with FIG. 1A being a vertical sectional view of the hearth and FIG. 1B being a schematic horizontal cross-sectional view in the lower region according to section line IB-IB in FIG. 1A.
Figure 1B:
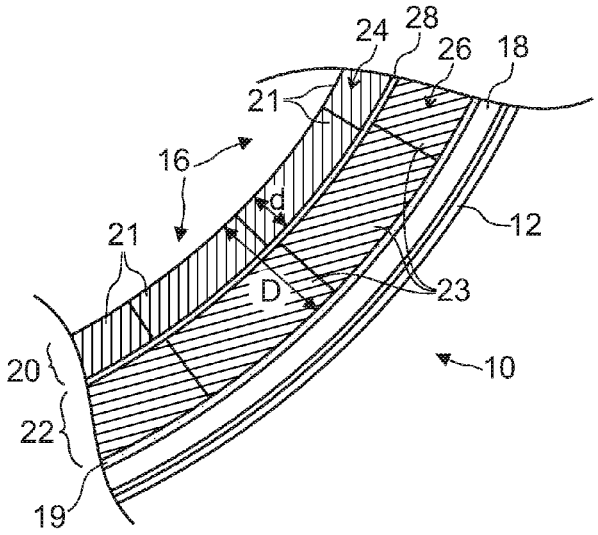

FIGS. 1A-1B schematically illustrate a hearth of a metallurgical reactor, more specifically of a blast furnace. The hearth is generally identified by reference 10. In known manner, the hearth 10 has an outer shell 12. The shell 12 is a welded steel structure that may be cylindrical as seen in FIG. 1A or conical in vertical cross-section (not shown). In known manner, one or more tapholes 14 (see FIGS. 3-4) are provided in an upper region of the shell 12 for tapping molten pig iron and slag. The hearth 10 encloses an annular circumferential wall lining, generally identified by reference 16. The hearth 10 also has a bottom lining i.e. a hearth pad 17 of per se known configuration. The inner surface of the wall lining 16 and the top surface of the pad 17 radially and axially delimit the useful volume inside the hearth 10.

The annular wall lining 16 extends over the full circumference of the hearth 10 and has, except for a limited circumferential angular sector around the taphole(s) 14 having an extent of 10-35°, a rotationally symmetrical configuration as shown in FIG. 1B. FIGS. 1A-1B further schematically illustrate liquid-cooled cooling members 18 e.g. cooling staves made of cast-iron or copper. The cooling members 18 are arranged in rings fixed inside the shell 12, between the shell 12 and the outer face of the wall lining 16, and connected to a known kind of forced-circulation cooling system. The cooling members 18 may also be replaced by or complemented by an arrangement for spray cooling the outer shell 12. An outer layer of thermo-conductive ramming mass 19, e.g. a suitable carbonaceous mass, warrants thermo-conductive contact of the cooling members 18 with the outer face of the wall lining 16. In known manner, the cooling members 18 cool the wall lining 16 in order to generally reduce its wear and, specifically, in order to form a permanent protective accretion (skull/scrab) of solidified matter on the inner surface of the wall lining 16 during operation. In between the shell 12 and the cooling members 18, an insulating ramming mass (not shown) may be provided so as to lower the temperature of the shell 12.

The present invention is specifically concerned with the configuration of a lower region of the wall lining 16, as illustrated at "h" in FIG. 1A. Other known details concerning the hearth 10 configuration are therefore omitted. As is well-known, the lower region h is typically one of the most critical regions in terms of wear, in which—in case of a blast furnace—the so-called "elephant-foot" wear pattern typically occurs. This lower region h typically extends partly into the hearth pad 17 and approximately 1000-1400 mm upwards from the bottom surface of the hearth (top-of-pad). As will be appreciated, the embodiments described hereinafter are beneficially applied in this critical region h. Nevertheless, the following teachings may, of course, also be applied at higher levels e.g. over entire height H from underneath the taphole(s) 14 to the top of the pad 17, which typically measures of 800-3500 mm from taphole center-line to top-of-pad (not shown).

According to section lines IB-IB of FIG. 1A, FIG. 1B illustrates a cross-section through a lowermost row of refractory elements of the wall lining 16, more specifically, at or immediately above the top of the pad 17. This level typically has the thickest wall lining, i.e. the total thickness of the wall lining 16 as indicated at D in FIG. 1 is maximal at the lower end of the wall lining 16 immediately atop the pad 17. As seen in FIG. 1A however, the lower region of the wall lining 16 may have a uniform thickness (extent in radial direction) corresponding to the total wall thickness D over its entire height H from top of the pad to the taphole(s) 14. In any geometry and type of reactor, the wall lining 16 is a self-supporting structure made of refractory material suitable for containing a bath that includes mainly molten metal, especially molten pig iron, and other constituents such as slag.

More specifically, as shown in FIGS.1A-1B, the wall lining 16 has a first inner layer 20 on the side of the interior of the hearth 10 and a second outer layer 22, which backs the inner layer 20, on the side of the shell 12. Each of the two layers 20, 22 forming the lower region of the wall lining 16 is respectively built of several vertically stacked inner and outer rings 24, 26 made of refractory elements assembled in circumferential direction. Each ring 24, 26 thus forms a horizontal annulus extending fully around the center of the hearth 10. As seen in FIG.1, the refractory elements are comparatively thick blocks so that each of the rings 24, 26 comprises, in radial direction, of a respective single refractory block 21, 23 having the thickness of the respective ring 24, 26. The width of the blocks 21, 23 thus also defines the respective thickness of the inner and outer layers 20, 22 respectively. However, although not illustrated and not considered preferred, either ring 24, 26 could also be made of multiple annular layers of comparatively smaller bricks. As opposed to bricks, in the present context, the expression block refers to elements that have a total volume of at least $20dm^3$ (0.02m3), e.g. dimensions exceeding 200x200mm (height x width) and lengths (in circumferential direction) in excess of 500mm. In the embodiment of FIGS.1A-1B, each of the two layers 20, 22, is a self-supporting annular wall of blocs 21, 23 of a masonry-type construction.

More specifically and according to the invention, the refractory blocks 21 of the inner ring 24 are made of a special high-performance carbonaceous first refractory material that contains as significant proportion of at least 5% by mass in total of a special property-enhancing additive in addition to or as an alternative to well-known metallic silicon and/or silicon carbide. Preferred carbonaceous refractory materials contain 50-85% by mass of carbon and, as a property-enhancing additive, 5-20% by mass in total of one or more material(s) chosen from the group of metallic titanium, titanium carbide, titanium nitride, titantium carbonitride or titanium oxide. Most preferably, a titanium carbide or titantium carbonitride (TiC) enhanced refractory according to EP 1 275 626, the contents of which are incorporated by reference herein, is used for making the blocks 21 of the inner rows 24. The refractory according to EP 1 275 626 further comprises 5-15% by mass in total of metallic silicon and 5-15% by mass in total of alumina. Other high-performance refractories are not excluded for producing refractory blocks 21 suitable for use in the inner rings 24 according to the invention. Other additives include graphite particles and ceramics other than silicon carbide, which may be included in the carbonaceous refractory material to improve its properties. Another less-preferred refractory is known from U.S. Pat. No. 3,007,805, which proposes, among others, a zirconium carbide-bonded graphite refractory as an alternative to a silicon carbide-bonded graphite refractory. However, in the inner refractory blocks 21, a refractory material according to EP 1 275 626, as available e.g. under the commercial designation BC-15SRT from Nippon Electrode Company Ltd, is preferred because of its additional resistance against carburization dissolution, especially in case the bath 10 is not saturated in carbon (e.g. in view of reducing carbon oxide emissions).

In the embodiment illustrated in FIGS. 1A-1B, there are several vertically stacked inner rings 24, e.g. up to 6-8 rings, made of the same high-performance refractory material (see identical hatching) in the inner layer 20. That is to say a similar configuration as in the critical lower region h is applied over the full height H. The outer layer 22 in turn may comprise outer rings 26 of one or more different material, e.g. with a second refractory material (indicated by cross-hatching) in several of the lower rows 26 that has higher heat conductivity than a third material in the upper rows.

Figure 2A:
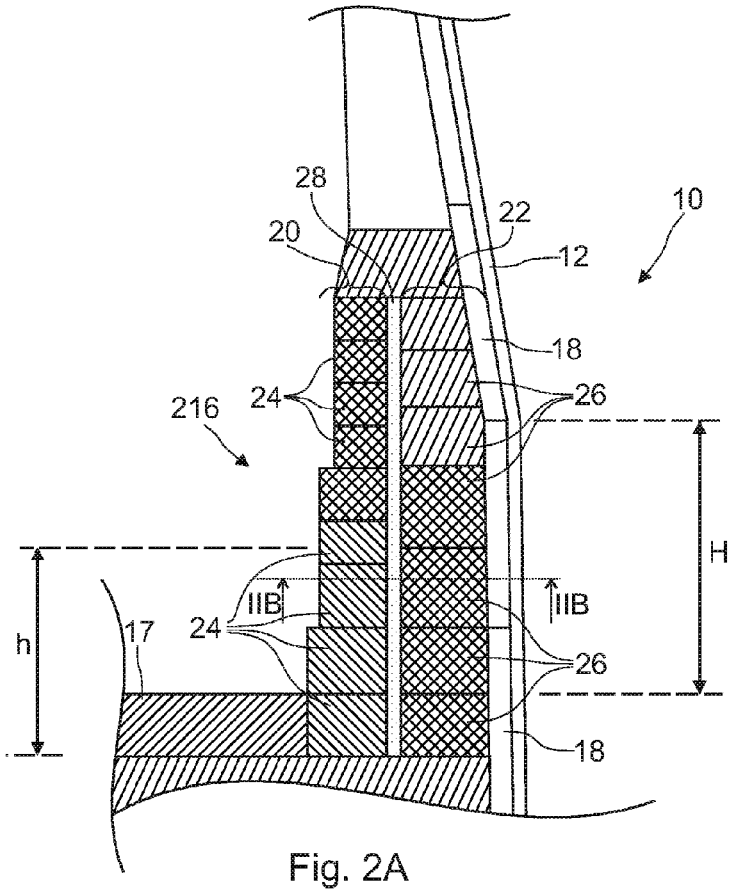
FIG. 2A-B illustrate a blast furnace hearth according to a second embodiment of the invention, with FIG. 2A being a vertical sectional view of the hearth and FIG. 2B being a schematic horizontal cross-sectional view in the lower region according to section line IIB-IIB in FIG. 2A.

Further according to the invention and as illustrated (not to scale) in FIG. 1B, the inner ring 24 has a thickness d of less than 45%, e.g. in the range of 200-600 mm, preferably in the range of 250-550 mm, of the total wall thickness D of the wall lining 16. This ratio applies to each of the vertically stacked inner rings 24 that constitute the relevant main region above the pad 17, especially the lower region h of the wall lining 16, irrespectively of their absolute thickness and is considered respectively at the vertical level of the inner ring 24 in question in case of varying thickness (as shown in FIG. 2A). With inner rings 24 having the thickness of a single block 21 as in FIGS. 1A-1B, the blocks 21 are machined to have a width equal to the thickness d of the inner ring, in function of the pre-determined dimensions of the wall lining 16. Consequently, as further appears from FIG. 1B, the outer rings 26 comprise blocks 23 of comparatively large-width (D-d) that is greater than 50%, preferably greater than 55% and more preferably greater than 65%, of the total wall thickness D of the wall lining 16 at the level of the outer ring 26 of concern. Concerning refractory material, the outer blocks 23 may be made of any suitable second conventional carbonaceous material, preferably a high-quality micropore or supermicropore refractory, having comparatively high thermal conductivity. Different types of outer blocks 23 may be used depending on the location (as seen in FIG. 1A). Preferably, the inner layer 20, more specifically the refractory blocks 21, comprises a material that also has a comparatively high thermal conductivity of at least 15 W/mK at 600° C., as can be achieved with materials according to EP 1 275 626.

As further seen in FIGS. 1A-1B, the wall lining 16 has an intermediate ramming layer 28 provided in between the outer layer 22 and the inner layer 20 so as avoid thermo-mechanical stress damage. In addition to permitting differential thermal expansion between the layers 20, 22, the intermediate ramming layer 28 warrants heat transfer there between. The intermediate ramming layer 28 is made of any suitable composition, preferably a special three-phase carbonaceous ramming composition. A first phase thereof is a fine granular phase comprising graphite, preferably artificial graphite obtained by anthracite calcination at high temperatures. The second phase is a coarse granular phase comprising ground, low porosity micro-porous carbon. The latter is preferably obtained by grinding production residues of high-quality supermicropore carbonaceous refractory. In typical manner, the composition comprises a suitable known binding phase conferring rammability to the ramming material. For the intermediate ramming layer 28, ramming compositions that have high thermal conductivity are used for best possible heat transfer between the heat-exposed blocks 21 and the outer blocks 23 that are cooled by the cooling members 18. As best seen in FIG. 1A, the annular ramming layer 28 extends in uninterrupted cylindrical manner substantially vertically in between the inner and outer layers 20, 22.

A specific preferred example of a configuration of the lower region below the taphole 14 of the wall lining 16 according to the above description of FIGS. 1A-B is as follows:

EXAMPLE 1

| | wall lining (16): | |
|---|---|---|
| | inner layer (20) | outer layer (22) |
| block material | high-conductive supermicropore cabon blocks with 5-20 wt % Ti or Ti-compound e.g. BC-15 SRT (i) | conventional high-conductive supermicropore cabon blocks |
| block width (of lowermost block) | ca. 500 mm | ca. 700 mm |
| total wall lining thickness (at lowermost block) | ca. 1200 mm | |
| number of inner rings with high-performance refractory | 7 | |
| construction type | independent self-supporting layers | |

(i): both available from Nippon Electrode Company Ltd.

As will be appreciated, the proposed wall lining 16 has the incontestable merit of minimizing the required total quantity of high-performance refractory, e.g. BC-15 SRT, and related cost while nevertheless reducing the total wall thickness (D) and maintaining a durable long-life configuration of the wall lining 16. As will be noted, a total wall thickness D of about 1200 mm, which is the maximum wall thickness at the lowermost row of blocks, represents a considerable reduction of up to 25% or more by comparison to functionally equivalent prior art linings that have typical wall thicknesses in the order of 1700-2000 m.

Figure 2B:
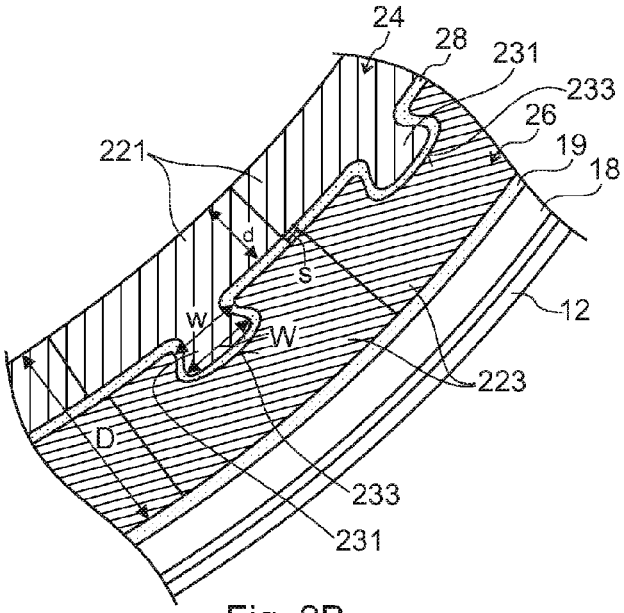

FIGS. 2A-B illustrate a further preferred embodiment, which differs mainly in that the use of high-performance refractory material is further minimized by two additional measures while the useful diameter of the hearth 10 is further increased. Firstly, the thickness of the inner layer 20 is reduced in absolute terms and it furthermore decreases from top-of-pad upwards. Secondly, the first refractory material that contains at least one property-enhancing additive (other than metallic silicon or silicon carbide) is used in a reduced number of inner rows 24 (as illustrated by different hatching).

The embodiment of FIGS. 2A-2B permits putting into practice e.g. the following example:

EXAMPLE 2

| | wall lining (216): | |
|---|---|---|
| | inner layer (20) | outer layer (22) |
| block material | high-conductive supermicropore cabon blocks with 5-20 wt % Ti or Ti-compound e.g. BC-15 SRT (i) | conventional high-conductive supermicropore cabon blocks |
| block width (of lowermost block) | ca. 300 mm | ca. 700 mm |
| total wall lining thickness (at lowermost block) | ca. 1000 mm | |
| number of inner rings with high-performance refractory | 4 | |
| construction type | inner layer (20) anchored to self-supporting outer layer (22) | |

(i): both available from Nippon Electrode Company Ltd.

Hereinafter, only major differences and relevant common features of the wall lining 216 with respect to that of FIGS. 1A-1B will be detailed, other already described features being identical.

The wall lining 216, as best seen in FIG. 2B, also has an inner layer 20 and an outer layer 22 of respective rings 24, 26. The inner layer 20 is also built of refractory blocks 221 that are made of a TiC enhanced refractory as set out above. In contrast to FIGS. 1A-1B however, the thickness d of the inner ring 24 is further reduced to less than 35% of the total wall thickness D of the lining 216 at the considered height. Accordingly, the refractory blocks 221 generally have a small width d of about 200-400 mm. In order to ensure proper stability, according to an independent aspect of the present disclosure, the small-width refractory blocks 221 of the inner ring 24 are anchored to the refractory blocks 223 of the outer ring 26 by means of cooperating anchoring portions.

To this effect, as best seen in the enlarged view of FIG. 2B each small-width refractory block 221 of the inner ring 24 has an anchoring portion, more specifically a rounded mushroom-shaped protrusion 231 on its convex outer face. The corresponding refractory blocks 223 of the outer ring 26 present a cooperating anchoring portion, e.g. a conjugated mushroom-shaped recess 233 on their concave inner face. The anchoring protrusions 231 and recesses 233 are configured with conjugated shape so as to warrant a sort of "loose" form-fit (positive fit) engagement. More specifically, as can be achieved e.g. by a generally dove-tail shape of the protrusions 231 in horizontal section, the protrusions 231 and conjugated recesses 233 are configured to secure i.e. fasten the small-width blocks 221 against dislocation in radially inward direction and tangentially i.e. in circumferential direction with respect to the large-width blocks 223. According to a dovetail-type connection, the maximum circumferential measure of the protrusions 231, indicated at W, is equal to or greater than the minimum circumferential measure of the recesses 233, indicated at w. As further seen in FIG. 2B, the protrusions 231 and conjugated recesses 233 are dimensioned so as to form there between a small gap, in the order of 20-100 mm, preferably 40-60 mm, when engaged. The gap permits an uninterrupted intermediate ramming layer 28 to pass there through, i.e. between the outer face of the inner blocks 221 and the inner face of the outer blocks 223, as seen in FIG. 2B so that the function of the ramming joint is continuously assured. As will be understood, other types of anchoring portions 231, 233, and inverting the position of protrusions and recesses is equally within the present scope. In any case, smooth rounded shapes are preferred in favor of the ramming layer 28. As further appears from FIG. 2B, the blocks 221 of the inner ring 24 are arranged with their joints staggered by a small extent, indicated at s, with respect to the blocks 223 of the outer ring. Accordingly, in the protrusions 231 and recesses 233 are arranged slightly eccentrically in circumferential direction within the respective blocks 221, 223.

Furthermore, as best seen by virtue of different hatching in FIG. 2A, this embodiment comprises an inner layer 20 with a more limited number of inner rings 24 that have refractory blocks 221 made of the special first refractory material. For instance, only the lower four rings 24 may be made of such refractory blocks 221, so as to cover only the critical lower region h itself, without extending over the full height H. The further inner rows 24 above may be made of the same conventional refractory used in the outer rows 26. As will be understood, the anchoring configuration with cooperating anchoring portions 231, 233 is beneficially applied over the entire height H, and even beyond, irrespectively of the material used in the refractory blocks of the inner and outer layers 20, 22. As will be appreciated, the proposed mode of anchoring allows using an inner layer of very small thickness without affecting the ramming layer 28.

As will also be noted, in the embodiment of FIGS. 2A-2B, the inner layer 20 does not have a straight cylindrical hot face, since the thickness d of the inner layer 20 is decreases by steps in upward direction. Accordingly, the width d of the bricks 221 is individually minimized according to the requirements of the vertical level that is considered.

Figures 3A, 3B:
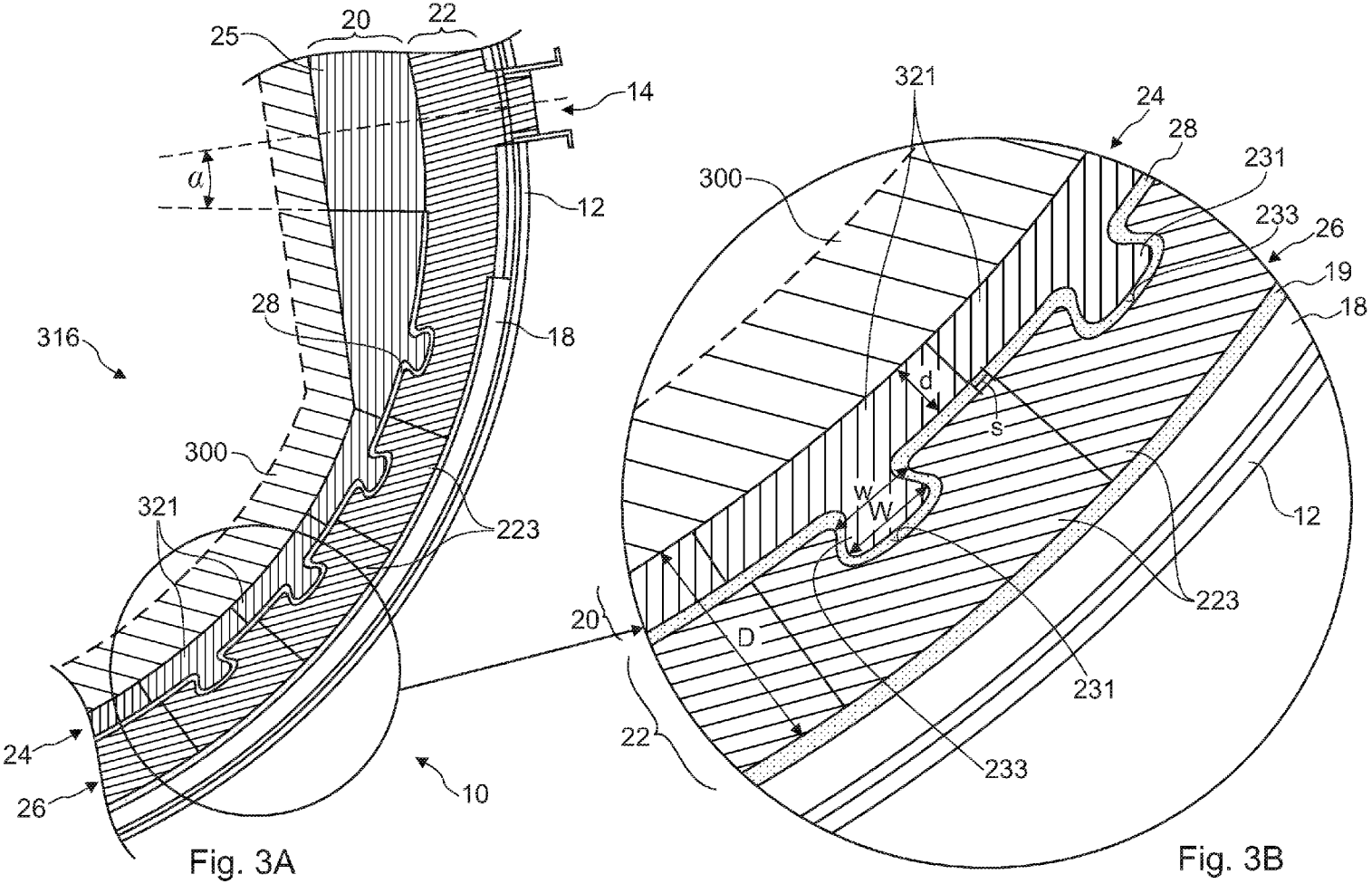
FIGS. 3A-3B are schematic horizontal cross-sectional views of a blast furnace hearth according to a third embodiment of the invention, with FIG. 3B showing an enlarged view of a region of FIG. 3A.

FIGS. 3A-3B illustrate a third embodiment that differs from the previous embodiments of FIGS. 2A-B mainly in three aspects, which need not necessarily be applied in combination. Firstly, a ceramic cup is provided. Secondly, and in consequence, the inner layer 20 has a straight cylindrical hot face (not shown). Thirdly, the absolute thickness of the inner layer 20 is further reduced, taking advantage of the ceramic cup.

Accordingly, as seen in FIGS. 3A-3B, the wall lining 316 according to the third embodiment comprises an innermost protective layer 300 of ceramic material, e.g. SiAlON-bonded high-alumina content bricks, for protecting the inner and outer layers 20, 22. In a manner known per se, the ceramic layer 300 extends above and beyond the lower region h and is generally separated from the carbon layers, i.e. in case of FIGS. 3A-B, from the inner layer 20, by means of a comparatively thick joint (e.g. 10-15 mm) of a castable or ramming mass (not shown). The annular ceramic layer 300 is part of a ceramic cup built in known manner and has a comparatively small wall thickness, e.g. 300 mm. Use of a ceramic cup 300 is especially but not exclusively recommended when operating the hearth 10 with a bath that is not saturated in carbon. As further seen in a sector of +/−α, e.g. of +/−5-12.5°, around the centre-line of the taphole 14 as shown in FIG. 3A, the inner ring 20 comprises special blocks 25 of larger central width in this small sector. Accordingly and as equally applies to the previous embodiments of FIGS. 1A-1B and FIGS. 2A-2B, in this circumferentially limited region (of e.g. 10-25°), the wall lining 216 of FIG. 2 has a larger total wall thickness, e.g. of 1500-2100 mm. The larger thickness is required at the taphole 14 to achieve the desired tapping rate. As will be noted, the block(s) 25 around the taphole 14 may be made of a refractory material different from that of the blocks 21, 221, 321. As will be understood, the taphole blocks 25 do not require anchoring portions 231, 233 because they are devoid of a backing ramming layer 28.

Accordingly, the embodiment of FIGS. 3A-3B allows construction of a hearth according the following:

EXAMPLE 3

With Ceramic Cup

| | wall lining (316): | |
|---|---|---|
| | inner layer (20) | outer layer (22) |
| block material | high-conductive supermicropore cabon blocks with 5-20 wt % Ti or Ti-compound e.g. BC-15 SRT (i) | conventional high-conductive supermicropore cabon blocks |
| block width | ca. 300 mm | ca. 700 mm |
| total wall lining thickness (at lowermost block) | ca. 1300 mm (including 300 mm ceramic cup) | |
| number of inner rings with high-performance refractory blocks | 4 | |
| construction type | inner layer (20) anchored to self-supporting outer layer (22) with additional innermost ceramic layer (400 mm width) | |

Figures 4A, 4B:
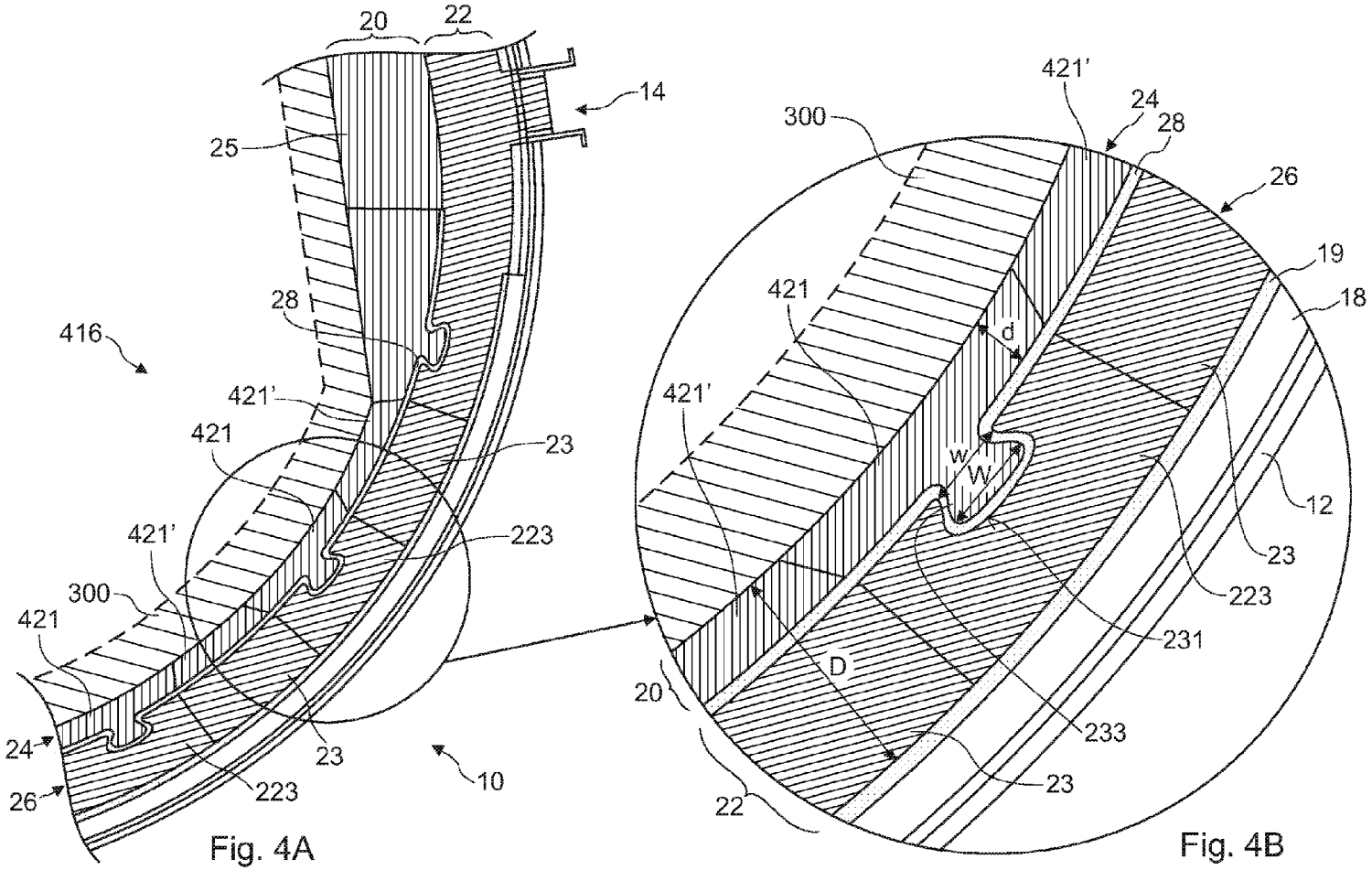
FIGS. 4A-4B are schematic horizontal cross-sectional views of a blast furnace hearth according to a fourth embodiment of the invention, with FIG. 4B showing an enlarged view of a region of FIG. 4A.

Another preferred embodiment of a wall lining 416 is illustrated in FIGS. 4A-4B, of which only the differences with respect to FIGS. 3A-3B are described hereinafter. This embodiment enables a small-width inner ring 24 using a different mode of anchoring to the outer ring 26. As best seen in FIG. 4A, the inner ring 24 has two different types small-width blocks 421, 421' arranged in circumferential alternation, The first type of blocks 421 is of comparatively small circumferential extent and provided with a form-fit protrusion 231 similar to FIG. 4A, which is however centrally arranged in the blocks 421. The second type of blocks 421' is devoid of form-fit protrusion and may have a comparatively large circumferential extent. As best seen in FIG. 4B, the first and second type of blocks 421, 421' have conjugated cooperating horizontal cross-sections for securing the second type of small-width blocks 421' devoid of anchoring protrusions together with the first type of small-width blocks 421 to the blocks 223 of the outer ring 26. As seen in FIG. 4B cooperating shapes may for instance be achieved using oblique tangential faces conferring generally trapezoidal conjugated cross-sections to the small-width blocks 421, 421'. The second type of blocks 421' and thus the inner ring 24 is more economical to manufacture when compared to FIG. 3A-B. Moreover, in the outer layer 22, at the circumferential location of a second type of small-width blocks 421', simple blocks 23 without anchoring portion can be used as in FIG. 2B. Consequently, the total number of blocks 223 and 421 in the inner layer 20 and in the outer layer 22 that require special manufacturing for providing the anchoring portions 231, 233 is reduced. Other features of the embodiment of FIG. 4A-B are however identical. As will be understood however, an anchoring configuration according to FIG. 4A-B may be used independently of the presence of a ceramic cup 300 or of the type of material of the anchored bricks 421, 421' with the benefit or reducing the number of special shaped blocks 421, 223' with an anchoring portion up to 50%.

In conclusion, as will be appreciated, a configuration of the wall lining 16, 216, 316, 416 according to the present invention permits achieving a total wall thickness D of the wall lining 16 of less than 1350 mm, even less than 1100 mm, in case no ceramic layer 300 is provided, and less than 1500 in case a ceramic layer 300 is provided. This is achieved in cost effective manner by providing a multi-layer wall lining 16 by virtue of a small-width inner layer of high-performance carbonaceous refractory that has a width d of less than 600 mm, preferably less than 400 mm.

While not being limited in application thereto, the present invention is particularly applicable to blast furnace hearths 10.

The invention claimed is:

1. A hearth for a metallurgical reactor, said hearth comprising:

an outer shell and an annular wall lining having a height that is arranged inside said shell and made of refractory material for containing a bath including molten metal;

said wall lining having a lower region comprising:

a radially inner layer facing the interior of said hearth and comprising a plurality of inner rings of refractory elements, said inner rings having outer faces disposed away from the interior of said hearth, said outer faces aligned in a vertical direction with one another;

a radially outer layer facing said outer shell and comprising a plurality of outer rings of refractory elements, said outer rings having inner faces disposed away from said outer shell, said inner faces aligned in a vertical direction with one another and opposing and spaced from the outer faces of said inner rings to define a continuous, substantially vertical, cylindrical, intermediate gap between them;

at least one of said inner rings comprising elements made of a first carbonaceous refractory material different from one or more carbonaceous refractory materials of which said elements of said outer layer are made;

wherein said first refractory material contains, in a proportion of at least 5% by mass in total, at least one additive other than metallic silicon or silicon carbide, and wherein said at least one inner ring has a wall thickness of less than 45%, of the total wall thickness along the height of said wall lining, and wherein at least one inner ring comprises elements having an anchoring portion on their outer faces and at least one outer ring comprises elements having an anchoring portion on their inner faces, each pair of anchoring portions cooperating for securing an element of said inner ring against dislocation in a radially inward direction and a circumferential direction with respect to a corresponding element of said outer ring, and wherein said first refractory material contains 50-85% by mass of carbon and, as an additional additive, 5-20% by mass in total of at least one material selected from the group consisting of metallic titanium, titanium carbide, titanium nitride, titanium carbonitride, and titanium oxide.

2. The hearth according to claim 1, wherein said first refractory material further contains 5-15% by mass in total of metallic silicon; and 5-15% by mass in total of alumina.

3. The hearth according to claim 1, wherein one of said cooperating anchoring portions comprises a recess having a minimum circumferential measure and the other of said anchoring portions comprises a protrusion having a maximum circumferential measure recess engaged within the recess, said maximum circumferential measure of said protrusion being greater than said minimum circumferential measure of said recess, and wherein said protrusion and said recess engage to secure said inner ring against dislocation in a radially inward direction and a circumferential direction with respect to said outer ring.

4. The hearth according to claim 1, wherein said lower region further comprises a granular intermediate ramming layer disposed in said intermediate gap that extends vertically in between said outer layer and said inner layer.

5. The hearth according to claim 4, wherein said ramming layer is made of a composition that comprises:

a fine granular phase consisting essentially of graphite;

a coarse granular phase consisting essentially of microporous carbon.

6. The hearth according to claim 3, wherein said at least one outer ring comprises large-width blocks made of a second carbonaceous refractory material, said at least one outer ring comprising large-width blocks that have a width greater than 65% of the total wall thickness along the height of said wall lining, and in that said at least one inner ring comprises small-width blocks having a width of less than 35% of the total wall thickness along the height of said wall lining.

7. The hearth according to claim 1, wherein said at least one inner ring comprises small-width blocks that have a mushroom-shaped anchoring protrusion comprising said protrusion on their outer face; and said at least one outer ring comprises large-width blocks that have a conjugated mushroom-shaped anchoring recess comprising said recess on their inner face;

said anchoring protrusions and said anchoring recesses being engaged and cooperating to secure said small-width blocks against dislocation in the radially inward direction and the circumferential direction with respect to said large-width blocks.

8. The hearth according to claim 1, wherein said at least one inner ring comprises small-width blocks of a first type and small-width blocks of a second type arranged in alternating fashion, said first type comprising an anchoring portion and said second type being devoid of anchoring portion, said first and second type of small-width blocks having respective conjugated horizontal cross-section that cooperate to secure said second type of small-width blocks.

9. The hearth according to claim 1, wherein said first refractory material has a thermal conductivity of at least 15 W/mK at 600° C.

10. The hearth according to claim 1, wherein said at least one inner ring is made, in radial direction, of a single refractory block having a width equal to the thickness of said inner ring and in that said at least one outer ring is made, in radial direction, of a single refractory block having a width equal to the thickness of said outer ring.

11. The hearth according to claim 1, wherein said inner layer comprises a sequence of at least two vertically stacked inner rings of refractory elements comprising refractory blocks, made of said first refractory material.

12. The hearth according to claim 1, wherein said inner layer forms the hot face of said lining and, at the level of the lowermost inner ring, said inner layer has a thickness in the range of 200 mm to 600 mm, and said wall lining has a total wall thickness of less than 1350 mm; or said wall lining further comprises an annular ceramic layer provided on the inside face of said inner layer, at the level of the lowermost inner ring, said inner layer has a thickness (d) in the range of 250 mm to 400 mm and said wall lining, including said ceramic layer, has a total wall thickness of less than 1500 mm.

13. The hearth according to claim 1, wherein the metallurgical reactor comprises a blast furnace.

14. A hearth for a metallurgical reactor, said hearth comprising:

an outer shell and an annular wall lining having a height that is arranged inside said shell and made of refractory material for containing a bath including molten metal;

said wall lining having a lower region comprising:

a radially inner layer facing the interior of said hearth and comprising at least one inner ring of refractory elements;

a radially outer layer facing said outer shell and comprising at least one outer ring of refractory elements, the inner ring disposed radially entirely within the outer ring;

said at least one inner ring comprising elements made of a first carbonaceous refractory material different from one or more carbonaceous refractory materials of which said elements of said outer layer are made;

wherein said first refractory material contains, in a proportion of at least 5% by mass in total, at least one additive other than metallic silicon or silicon carbide, and wherein said at least one inner ring comprises elements having an anchoring portion on their outer face and said at least one outer ring comprises elements having an anchoring portion on their inner face, each pair of anchoring portions comprising a protrusion having a maximum circumferential measure that is engaged within a recess having a minimum circumferential measure at the face in which said recess is disposed, said maximum circumferential measure of said protrusion being greater than said minimum circumferential measure of said recess, said protrusion and said recess cooperating for securing against dislocation in a radially inward direction and a circumferential direction an element of said inner ring with respect to a corresponding element of said outer ring, and wherein said first refractory material contains 50-85% by mass of carbon and, as an additional additive, 5-20% by mass in total of at least one material selected from the group consisting of metallic titanium, titanium carbide, titanium nitride, titanium carbonitride, and titanium oxide.

15. A hearth for a metallurgical reactor, said hearth comprising:

an outer shell and an annular wall lining having a height that is arranged inside said shell and made of refractory material for containing a bath including molten metal;

said wall lining having a lower region comprising:

a radially inner layer facing the interior of said hearth and comprising a plurality of inner rings of refractory elements;

a radially outer layer facing said outer shell and comprising a plurality of outer rings of refractory elements, the inner rings disposed radially entirely within the outer rings and spaced inwardly away from the outer rings to define a continuous, substantially vertical, cylindrical, intermediate gap between them;

at least one of said inner rings comprising elements made of a first carbonaceous refractory material different from one or more carbonaceous refractory materials of which said elements of said outer layer are made;

wherein said first refractory material contains, in a proportion of at least 5% by mass in total, at least one additive other than metallic silicon or silicon carbide, and wherein said at least one inner ring has a wall thickness of less than 45%, of the total wall thickness along the height of said wall lining, and wherein said first refractory material contains 50-85% by mass of carbon and, as an additional additive, 5-20% by mass in total of at least one material selected from the group consisting of metallic titanium, titanium carbide, titanium nitride, titanium carbonitride, and titanium oxide.

* * * * *